United States Patent [19]

Lindbergh

[11] 4,374,537

[45] Feb. 22, 1983

[54] COLLAPSING CLOSURE SYSTEM AND OPERATING MECHANISM

[76] Inventor: Charles Lindbergh, 10 S. Basilica, Charleston, S.C. 29406

[21] Appl. No.: 185,258

[22] Filed: Sep. 8, 1980

Related U.S. Application Data

[63] Continuation-in-part of Ser. No. 89,944, Oct. 31, 1979, Pat. No. 4,303,117.

[51] Int. Cl.[3] ..... E05D 15/26; E05F 1/04; E05F 11/06

[52] U.S. Cl. ..... 160/189; 49/126; 52/64; 160/207; 160/232; 160/236

[58] Field of Search ..... 160/189, 190, 206, 207, 160/35, 152, 232, 236; 49/126, 127; 52/64, 66, 72, 573

[56] References Cited

U.S. PATENT DOCUMENTS

| | | | |
|---|---|---|---|
| 540,421 | 6/1895 | Carter | 52/573 X |
| 1,750,042 | 3/1930 | Hoover | 160/190 |
| 1,962,913 | 6/1934 | Rutledge | 160/190 |
| 2,289,634 | 7/1942 | Dieter | 52/573 X |
| 2,423,987 | 7/1947 | Levikow | 160/207 X |
| 2,942,658 | 6/1960 | Wilson | 160/206 X |
| 3,297,077 | 1/1967 | Garbus | 160/206 X |
| 3,511,301 | 5/1970 | Graham et al. | 160/232 X |
| 3,757,845 | 9/1973 | Pagliaro | 160/189 |
| 3,861,103 | 1/1975 | Rasmussen | 52/573 X |
| 3,967,671 | 7/1976 | Stanley et al. | 160/232 |
| 3,980,123 | 9/1976 | Vago | 160/232 X |
| 4,119,133 | 10/1978 | Wolf | 160/232 X |

FOREIGN PATENT DOCUMENTS 730256 5/1955 United Kingdom .

*Primary Examiner*—Rodney H. Bonck
*Attorney, Agent, or Firm*—Newton, Hopkins & Ormsby

[57] ABSTRACT

Vertical and non-vertical collapsing panel closures for various applications are disclosed. The closure has reduced stacking height when collapsed and possesses a more energy efficient panel section guide roller system operating with a more economical and versatile upper and lower guide roller track arrangement. An insulated closure having an interior flush surface and an exterior rail and stile facade is achieved. A more simplified variable dynamic closure counterweighting system is provided.

25 Claims, 43 Drawing Figures

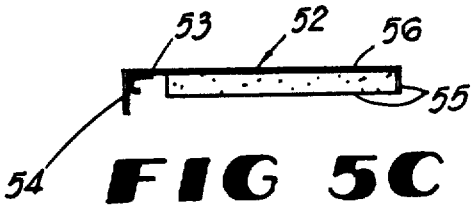
FIG 5C
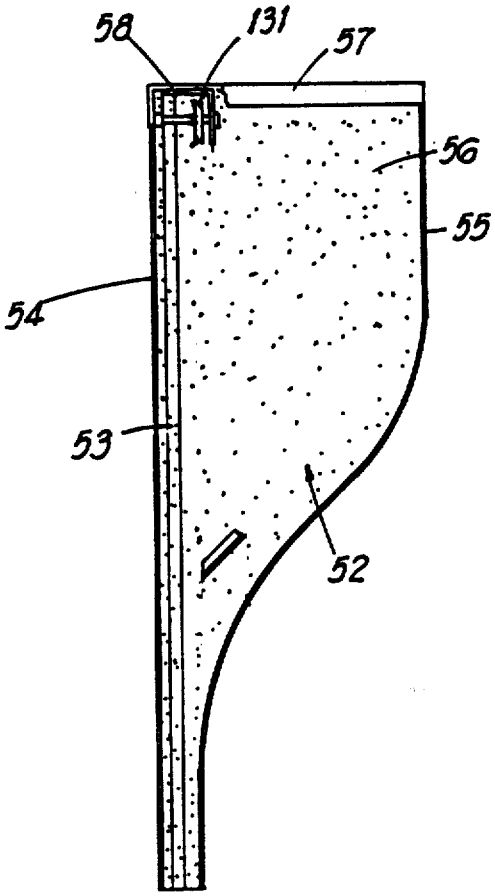
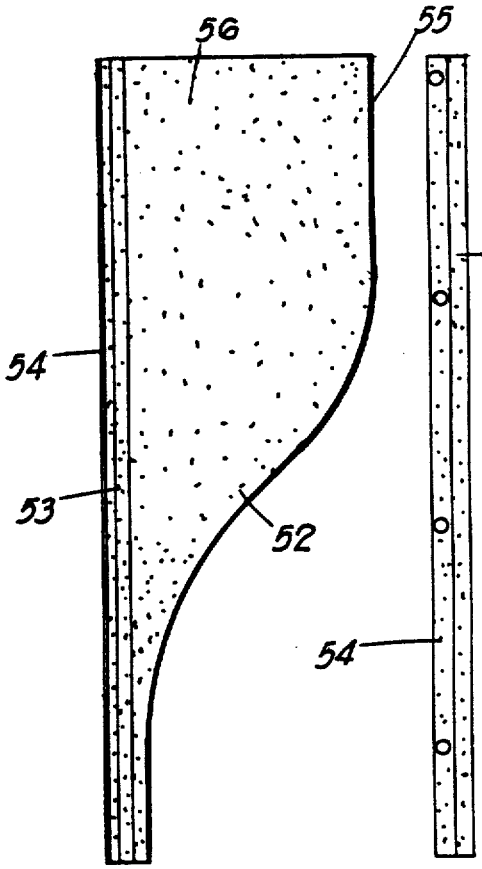
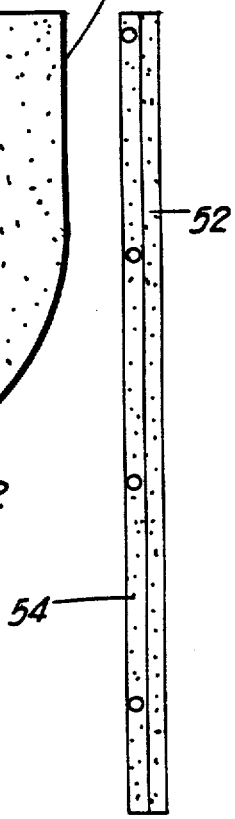
FIG 5A FIG 5B FIG 5D

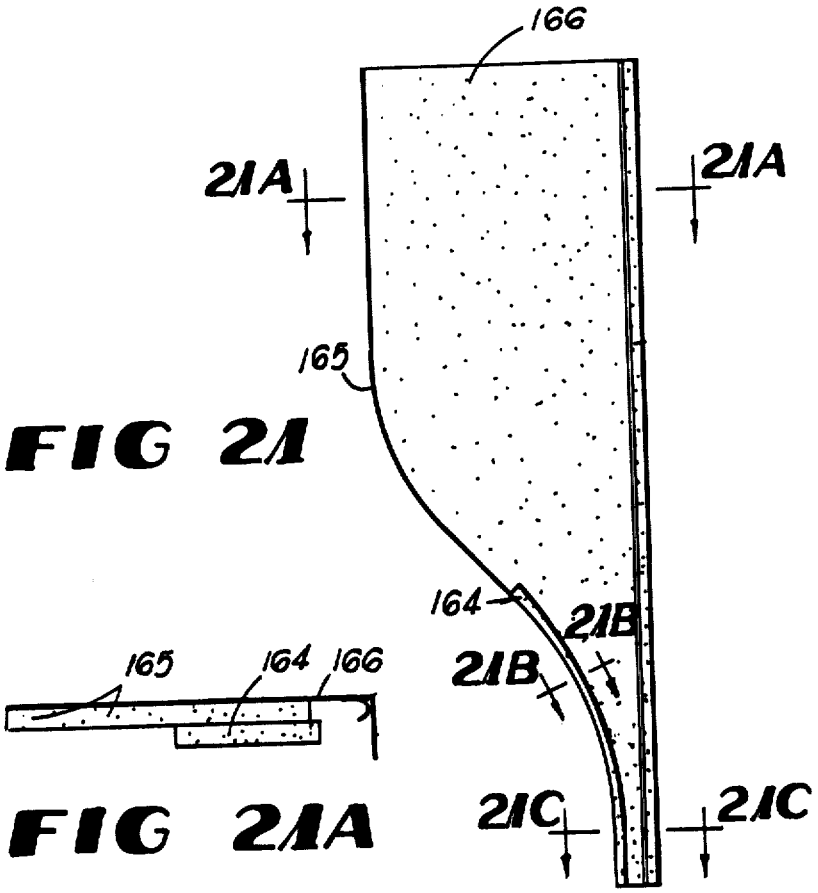
FIG 21
FIG 21A
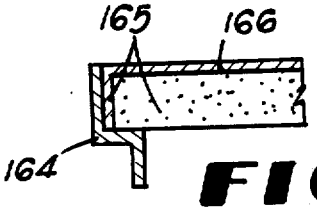
FIG 21B
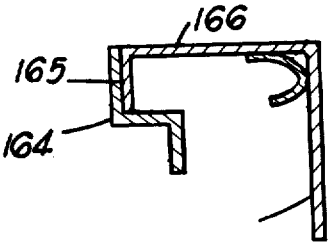
FIG 21C

COLLAPSING CLOSURE SYSTEM AND OPERATING MECHANISM

CROSS-REFERENCE TO RELATED APPLICATION

This application is a continuation-in-part of prior copending application Ser. No. 089,944, filed Oct. 31, 1979, for VERTICALLY COLLAPSING CLOSURE SYSTEM, now U.S. Pat. No. 4,303,117.

BACKGROUND OF THE INVENTION

The referenced patent application discloses a vertically collapsing overhead storable closure consisting of plural rectangular hingedly connecting panel sections and guide means for the collapsing closure between full open or stored and fully closed positions. The closure guide means in the application includes panel mounted roller assemblies, vertical guide rails at each side of the closure, and cam means to cooperate with the guide roller assemblies in the operation of the closure. A counterweight system for the movable closure has its counterweighting effectiveness varied with the position of the components which make up the counterweight to adapt the counterweight to varying forces exerted by the closure during the movement thereof.

The present invention seeks to improve on the collapsing closure in the referenced application in a number of respects. First, the invention provides a means of further reducing the overall height of the installed system through an improvement in guide roller mounting. Second, a more simplified upper guide roller track arrangement of lesser manufacturing cost is provided, along with a similarly improved lower guide track arrangement. The invention includes an embodiment suitable for a commercial or residential movable interior partition, to be used in lieu of current rotational and laterally movable interior partitions which occupy valuable floor space. The invention also provides an embodiment usable as a removable roof for shopping malls, swimming pool enclosures and the like. A very important feature of the invention resides in more energy efficient guide roller assemblies especially for large closures or partitions. More particularly, in the improved guide roller assemblies, the guide roller axis is capable of displacement laterally relative to the roller mounting bracket. This arrangement enables the closure panel sections to remain in a common vertical plane promoting appearance and weather-tightness.

The invention can provide a door that offers a rail and stile exterior facade, while incorporating section insulation and an interior flush surface more compatible architecturally with surrounding interior finishing. Currently, only flush closure sections are insulated while the more popular rail and stile variety possesses no adequate insulation with thicknesses limited to approximately one-quarter inch.

Another major feature of the present invention resides in a more simplified embodiment of a variable counterweight system. Finally, the invention provides as one of its features a unique means for latching the closure in its down or closed position.

BRIEF DESCRIPTION OF THE DRAWINGS

FIG. 5*a* is a side elevation of an upper guide rail unit.

FIG. 5*b* is a further side elevation of the upper guide rail, with parts broken away.

FIG. 5*c* is an end elevation of the upper guide rail.

FIG. 5*d* is an edge elevation thereof.

FIG. 18 is a perspective view showing an embodiment of the collapsing closure suitable for a swimming cool cover, roof or the like.

FIG. 21 is a side elevation of a modified form of upper roller guide rail having an interceptor plate to effect roller diversion.

FIG. 21*a* is a horizontal section taken on line 21*a*—21*a* of FIG. 21.

FIG. 21*b* is a similar section taken on line 21*b*—21*b* of FIG. 21.

FIG. 21*c* is a similar section taken on line 21*c*—21*c* of FIG. 21.

DETAILED DESCRIPTION

Figure 1:
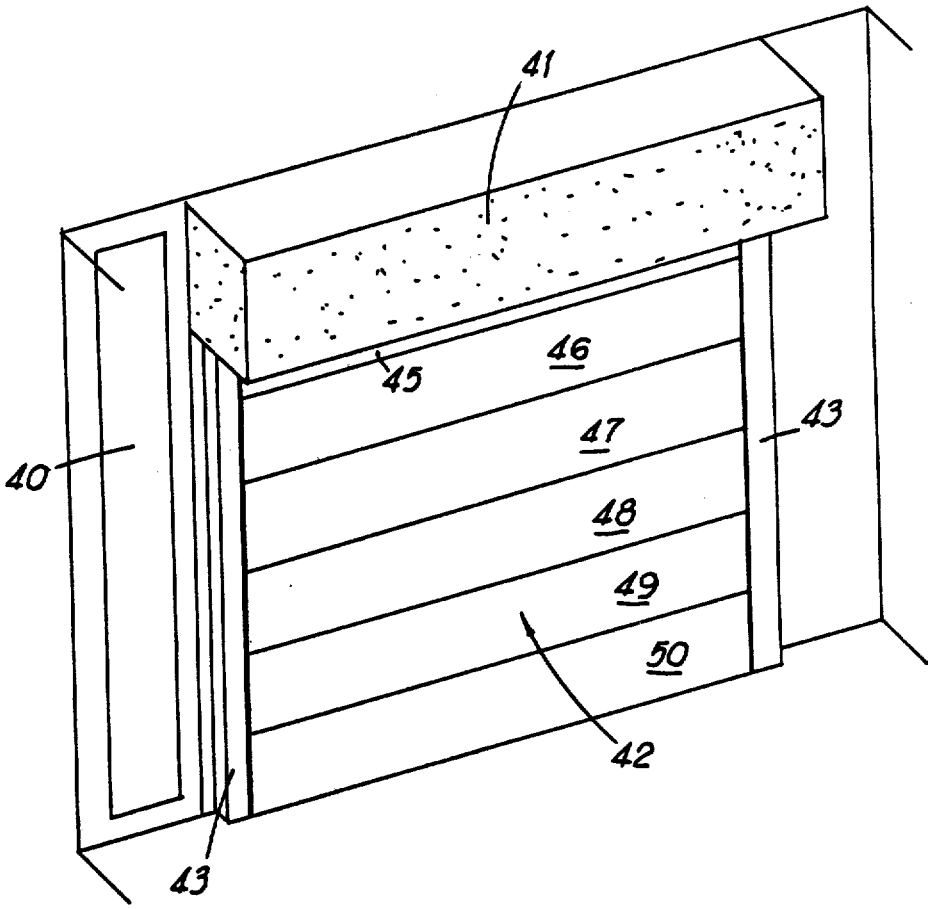
FIG. 1 is a perspective view showing the interior of a collapsing closure system according to the invention.
Figure 2:
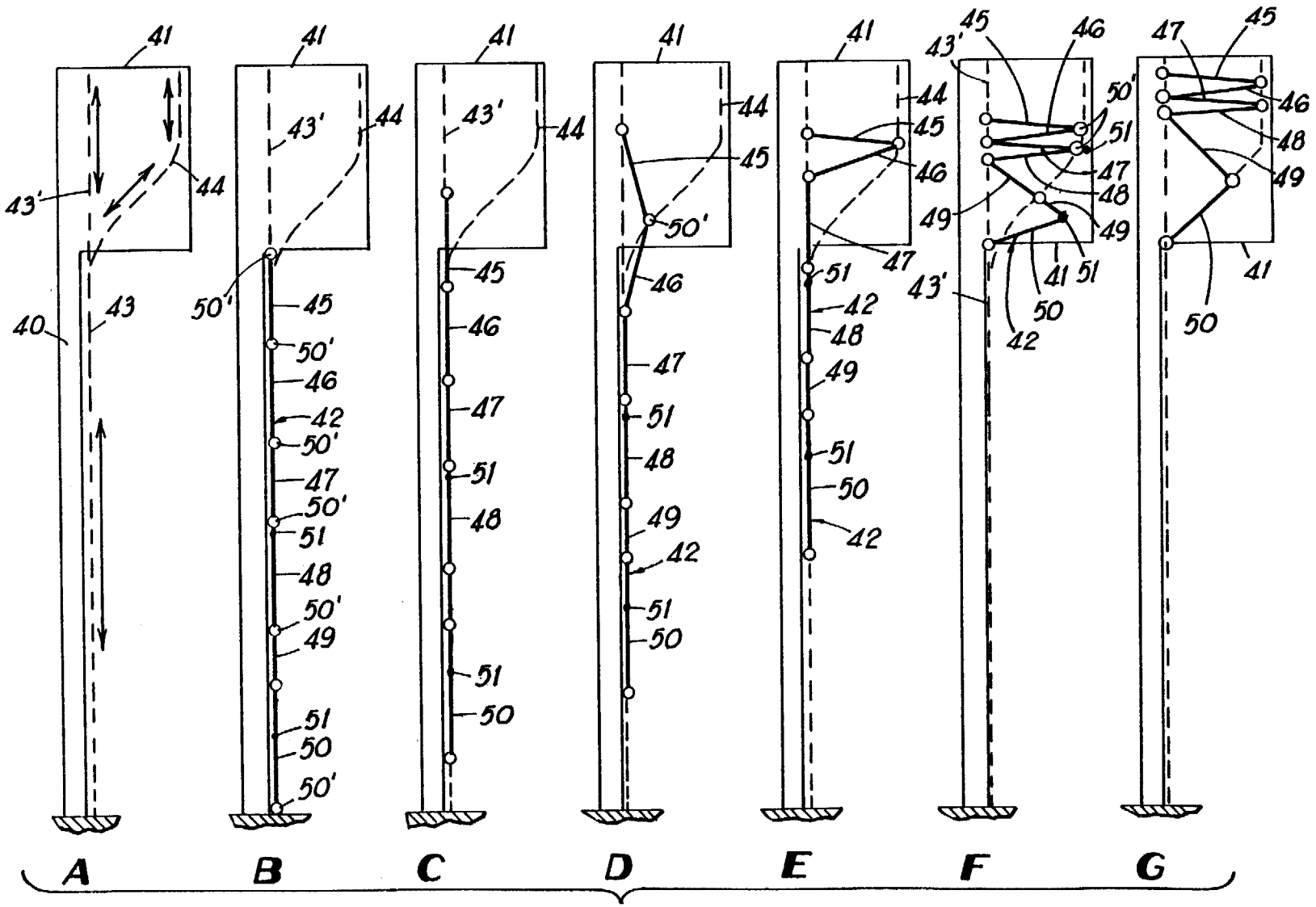
FIG. 2 is a composite schematic side elevation showing the operational stages of the collapsing closure system.

Referring to the drawings in detail and initially referring to diagrams (a) through (g) of FIG. 2, a first major improvements feature of the invention is schematically shown, namely, a substantial decrease in the collapsed height of the closure compared to the closure in the referenced application. Diagram (g) shows the collapsed height of the prior application closure, while diagram (f) shows the substantially reduced collapsed height of the closure herein. In these FIG. 2 diagrams, a vertical wall 40 and overhead interior storage cabinet 41 for the collapsed closure 42 are shown. The numeral 43 designates a vertical closure guide track extending at 43' in the cabinet 41. The numeral 44 designates a diversionary branch guide track extending into the storage cabinet 41.

In diagram (b), it is shown that the collapsing closure 42 comprises a plurality of equal width closure panel sections 45, 46, 47, 48, 49 and 50. These panel sections are equipped at opposite ends with guide rollers 50' which follow the tracks 43, 43' and 44. Except in two instances, the guide rollers 50' have their axes coinciding with the hinge or articulation axes 51 between the panel sections. The next-to-lowermost guide rollers 50' are substantially above the hinge 51 between the two lowermost panel sections 49 and 50 and are preferably on the panel section 49 near its vertical center. The next uppermost guide rollers 50' are on the panel section 47 slightly above the axis of hinge 51 between panel sections 47 and 48. This simple relocation of two pairs of guide rollers compared to the prior application makes possible the substantially reduced collapsed height of the closure 42 shown in diagram (f) of FIG. 2.

Diagram (c) shows the articulated closure 42 beginning to ascend into the storage cabinet 41 with the uppermost rollers 50' following the track section 43'. Diagram (d) shows the next lowermost rollers 50' being diverted onto the branch track 44. Diagram (e) shows the continued collapse of the two uppermost panel sections 45 and 46 and the vertical movement of the next lowermost panel section 47 along track section 43'. In diagram (e), the two sets of guide rollers 50' on panel sections 47 and 49, displaced upwardly from the adjacent hinges 51, have not yet reached the elevation of the cabinet 41.

In diagram (f) showing the fully collapsed state of the improved closure 42, these two displaced sets of rollers 50' have both been diverted to the branch track 44 as shown, resulting in the significantly reduced collapsed height of the closure compared to the prior referenced application. As stated, this is one of the major features of the present invention.

Figure 3:
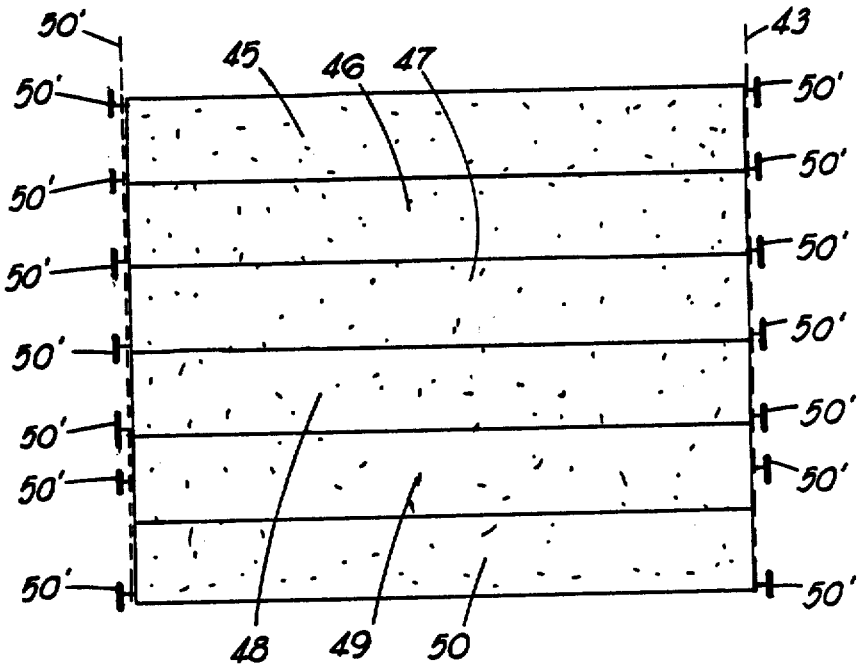
FIG. 3 is a fragmentary schematic interior elevational view of the closure showing panel section guide roller assemblies.

Schematic FIG. 3 showing the interior side of the fully down closure 42 depicts the panel sections 45 through 50, vertical guide tracks 43 and the sets of guide rollers 50' with the next-to-lowermost guide rollers 50' between panel sections 50 and 49 relocated upwardly on panel section 49 and the like guide rollers above panel section 48 relocated slightly upwardly on panel section 47 as described relative to diagram (b) of FIG. 2.

Figure 4:
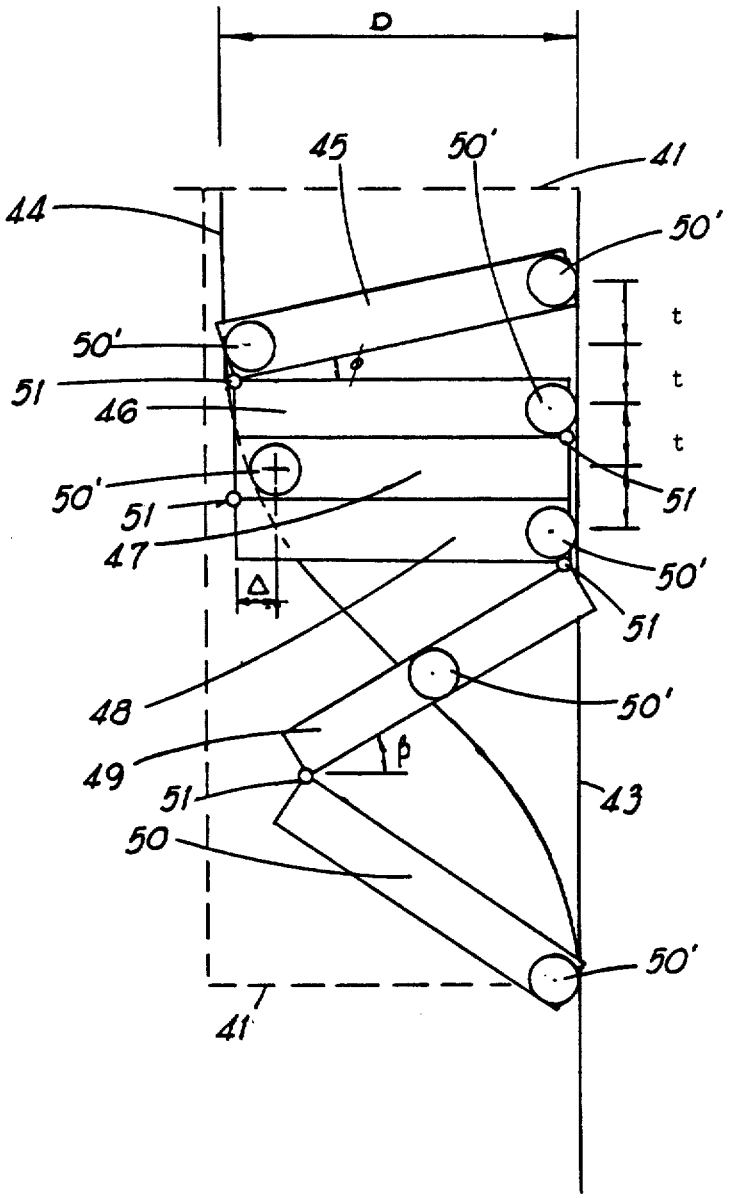
FIG. 4 is an enlarged elevational view of the collapsing closure corresponding to the position of the closure shown in FIG. 2 (*g*).

FIG. 4 corresponds to diagram (f) of FIG. 2 and shows in greater detail the geometry involved in the reduced height collapse of closure 42 due to relocation of two pairs of the rollers 50' relative to the adjacent hinge axes 51.

FIGS. 5(*a*) through 5(*d*) show another improvement feature, namely, an improved upper roller guide track system. Basically, each upper guide track unit of the system is stamped from sheet metal to form a variable width shallow pan 52 and a curved face roller guide rail section 53. The latter element can be spot welded to the pan 52 just inwardly of a vertical edge flange 54 thereof. Another edge flange 55 rises from the flat shear panel 56 of the pan 52 perpendicular thereto and this latter flange 55 follows the curved diversionary edge portion of the pan-like sheet metal track unit.

The straight edge flange 54 forms a mounting flange for connecting each upper guide track unit to the wall 40. It also serves to support the concave roller guide strip 53. The flange 55 serves to constrain the diverted panel guide rollers in the operation of the closure.

Each upper guide track unit is completed by the attachment thereto of an upper mounting bracket 57, closure lifting cable sheave assembly 58 and a small latch cable sheave, not shown.

Figure 6A:
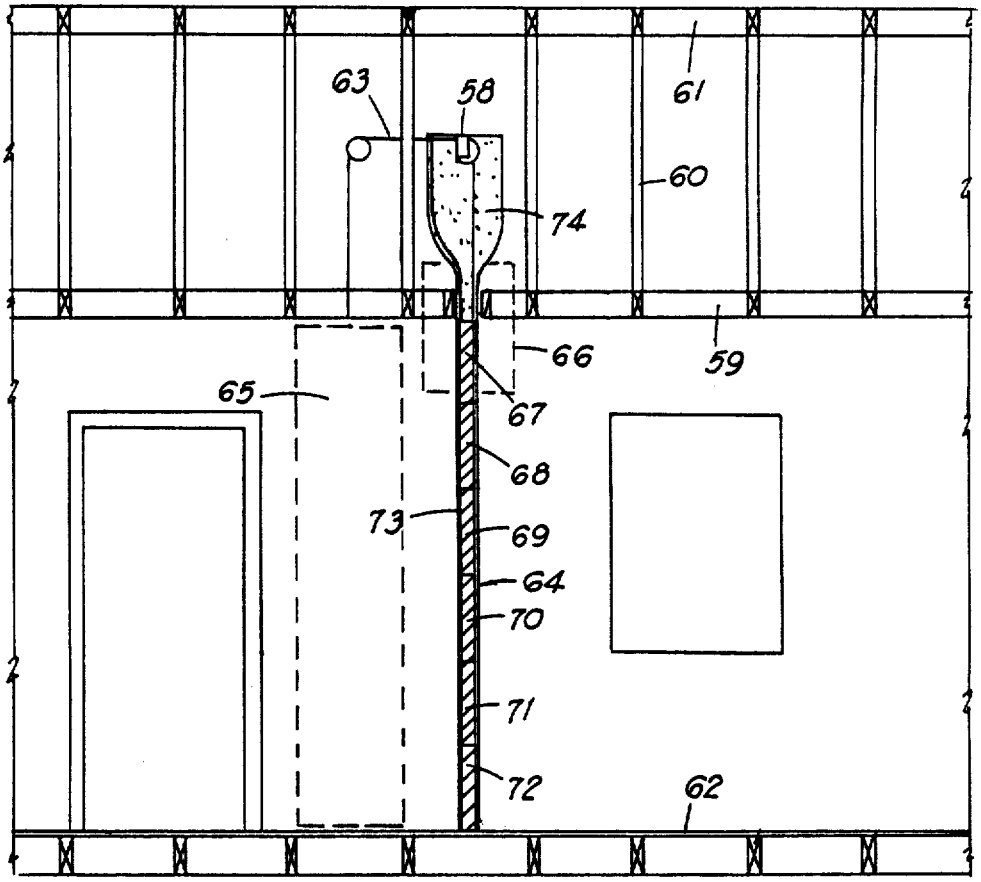
FIG. 6*a* is an elevational view showing the collapsing closure embodied in an interior partition for a residence.

FIGS. 6*a* through 7*a* show a further embodiment of the invention in the form of a vertical overhead collapsing and storing partition for residential or commercial facilities. As shown in FIG. 6*a*, ceiling joists 59, roof trusses 60 and ridge beam 61 form the facilities' overhead structure, the floor 62 and floor joists also being shown. Lifting cable means 63 for a collapsing vertical partition 64 are directed over to a variable counterweight system 65 which is concealed in a fixed wall space. An electric motor, not shown, and associated controls may be added in the usual manner. The partition 64 may collapse upwardly into the overhead space above the ceiling joists 59 or may collapse into a supported cabinet 66 similar to the previously-described cabinet 41.

The partition 64 may be constructed identically to the previously-described collapsing closure 42, and possesses a plurality of equal width hingedly connected panel sections 67, 68, 69, 70, 71 and 72 which are guided in their movement by the guide track means described in the prior embodiment of the invention including a vertical track portion 73 and overhead pan-type roller guide tracks 74. The guide rollers of the panel sections 67 through 72 are also positioned as described previously in FIGS. 2, 3 and 4 of the prior embodiment.

Figure 6B:
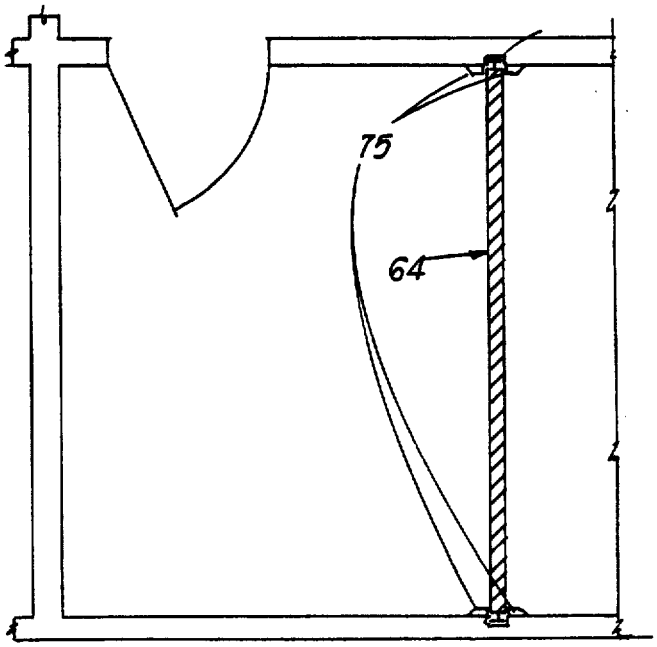
FIG. 6*b* is a plan view of the same.

As shown in FIG. 6*b*, a plan view, trim strips 75 are added to conceal each vertical track 73 for the sake of appearance and safety.

Figure 7:
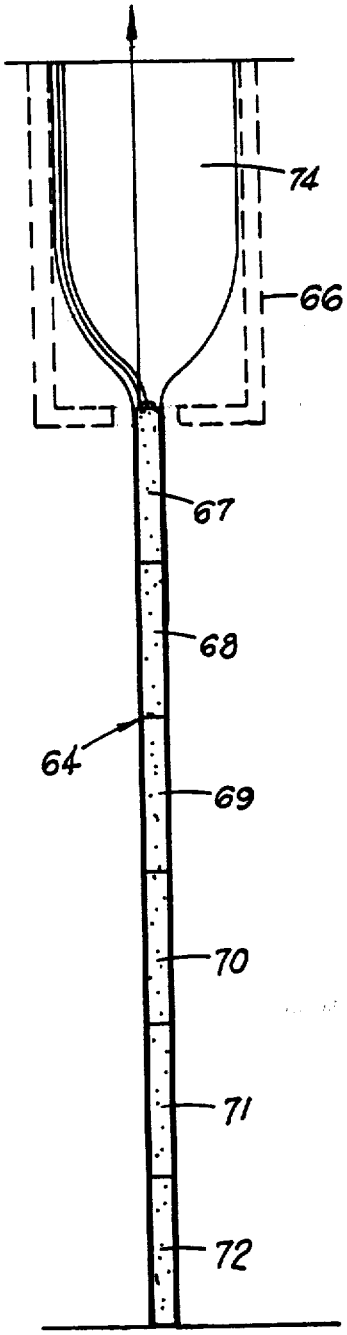
FIG. 7 is an enlarged vertical section through the interior partition in the full down position.
Figure 7A:
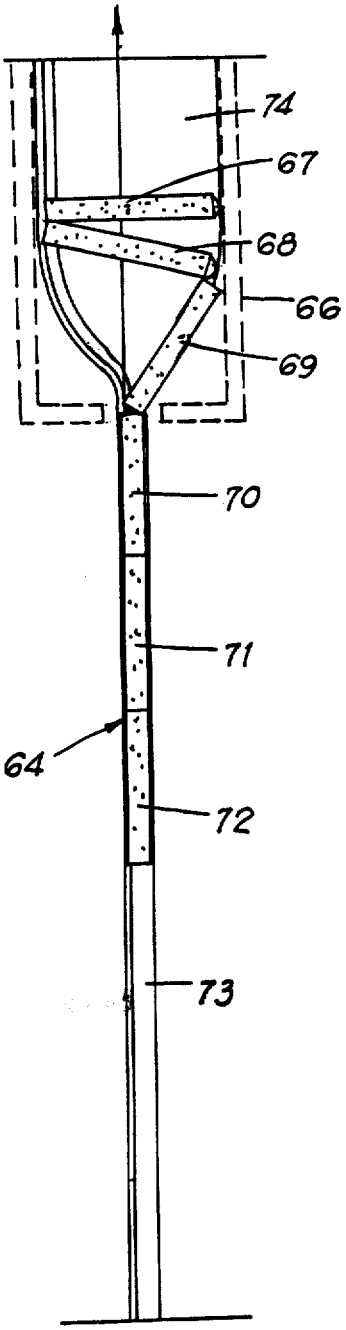
FIG. 7*a* is a similar view showing the partition in an intermediate position.

FIGS. 7 and 7*a* show the vertically collapsing partition 64 with the supported storage cabinet option 66. FIG. 7 shows the partition 64 in the full down position while FIG. 7*a* shows the overhead collapsing and storage mode which may correspond exactly to that described in the prior embodiment of FIG. 2, etc.

Figure 8:
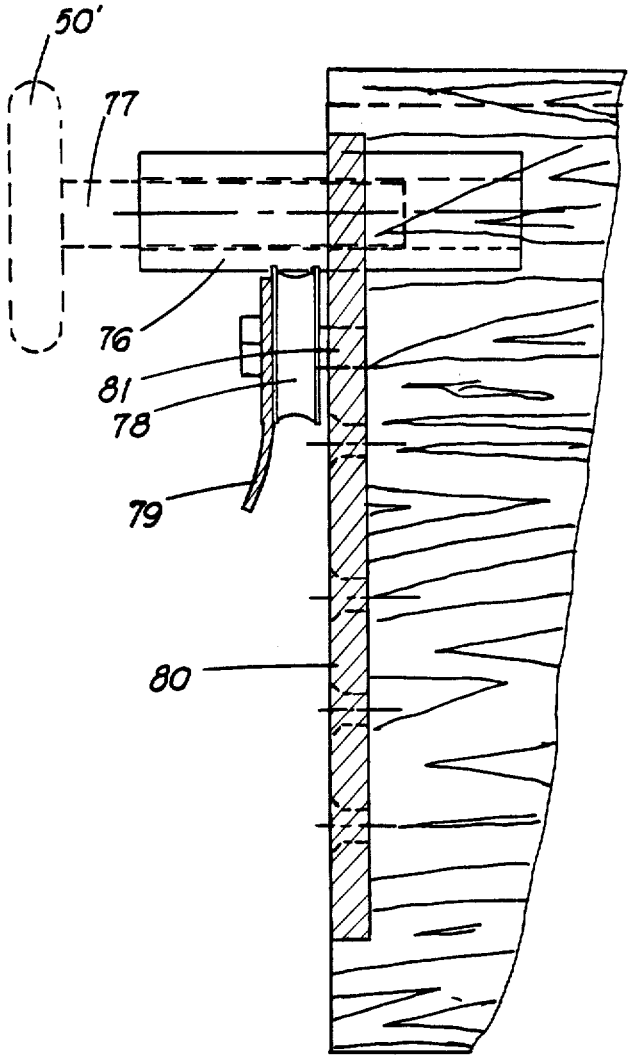
FIG. 8 is a fragmentary side elevation of a closure panel guide roller mounting assembly common to all but the two lowermost panel sections of the closure and also showing a lifting cable guide sheave.
Figure 8A:
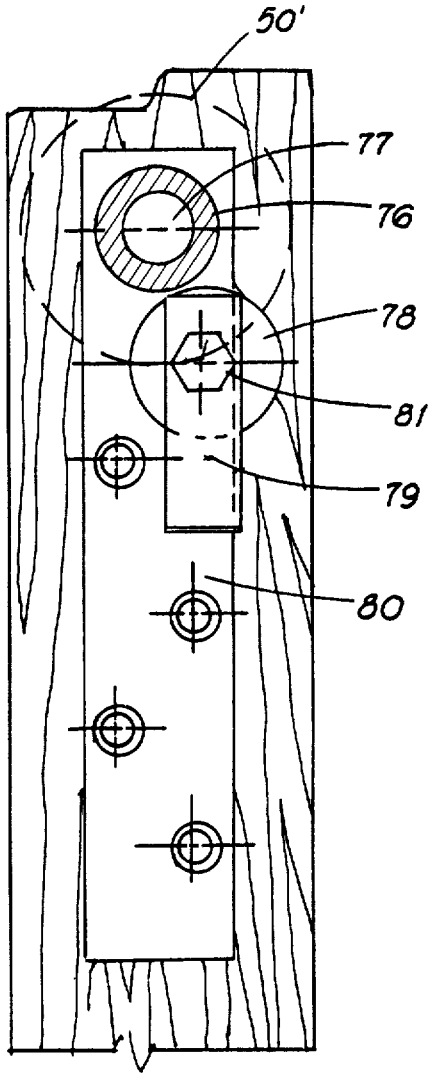
FIG. 8*a* is an end elevational view, partly in section, of the elements in FIG. 8.

FIGS. 8 and 8*a* are side and end views, respectively, of a roller guide assembly for all panel roller locations except those of the two lowermost panels 49 and 50 or 71 and 72. A bored cylindrical bar 76 has an internal diameter such that the inserted guide roller axle 77 can freely slide but does not allow sufficient vertical displacement of the roller 50'. Unless closure weights are heavy, such relative motion can occur without significant friction if a suitable machinery lubricant is used. Under heavier loads, low friction bearings or bushings may have to be employed. The length and wall thickness of the bar 76 are determined through usual structural considerations. In the case of wood closure panels, the bar 76 is deeply recessed into the panel, FIGS. 8 and 9*a*, and this doweling effect greatly increases strength. When necessary, a small sheave 78 is applied to accommodate the zigzag arrangement of the usual lifting cable means for the closure inducing panel joint moments. A retainer 79 for the lifting cable on the sheave 78 is preferably provided, as shown. The sheave and retainer are attached to an assembly mounting plate 80 using a headed axle pin 81 welded to the mounting plate 80.

Figures 9, 9A:
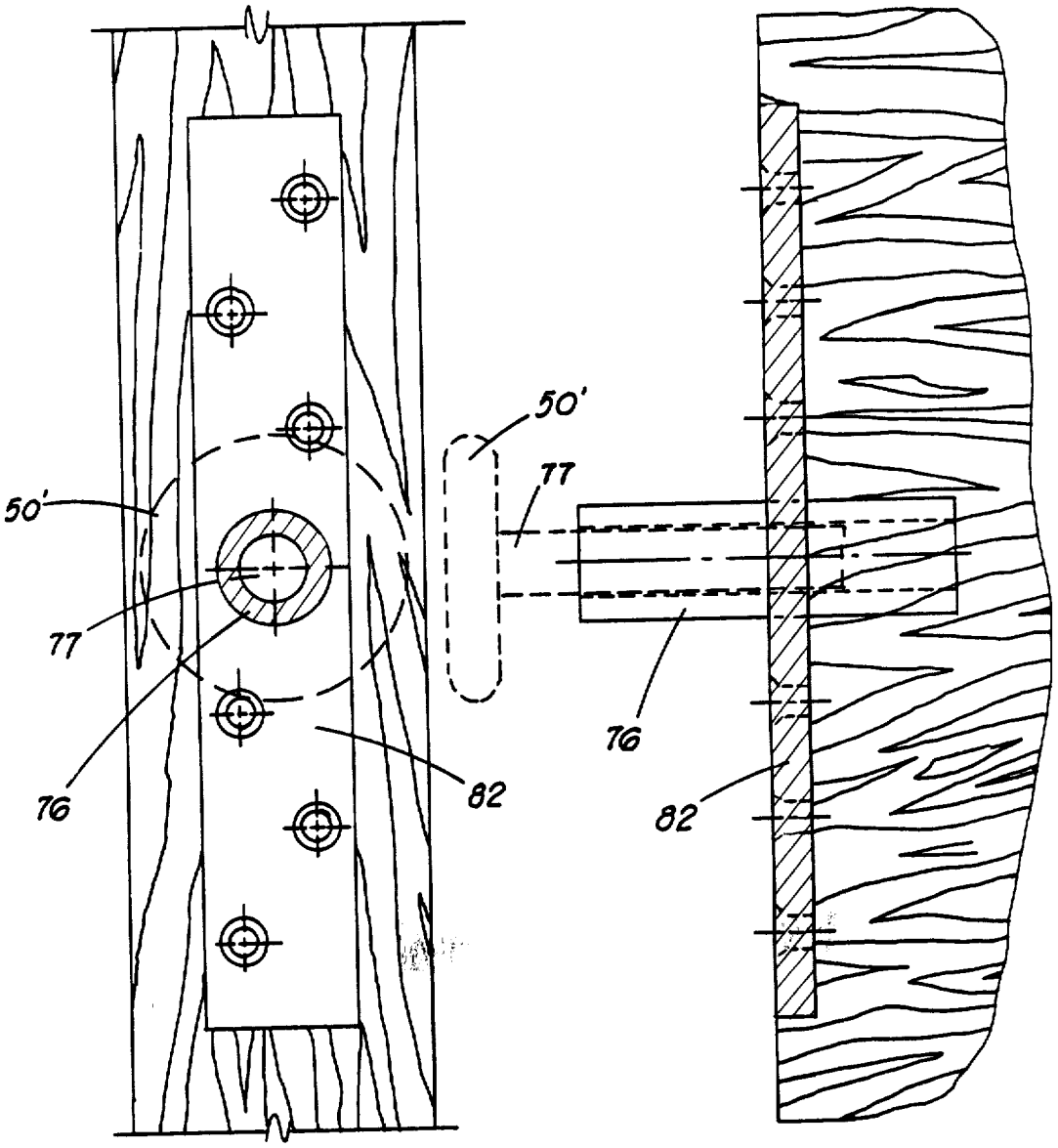
FIG. 9 is an end elevation of a guide roller mounting assembly for the next-to-lowest panel section.
FIG. 9*a* is a side elevation thereof.

FIGS. 9 and 9*a* show a similar mounting and guide assembly for the mid-level closure panels. The lifting cable sheaves 78 are absent and the geometry of mounting plate 82 is somewhat changed compared to the mounting plate 80.

Figure 10:
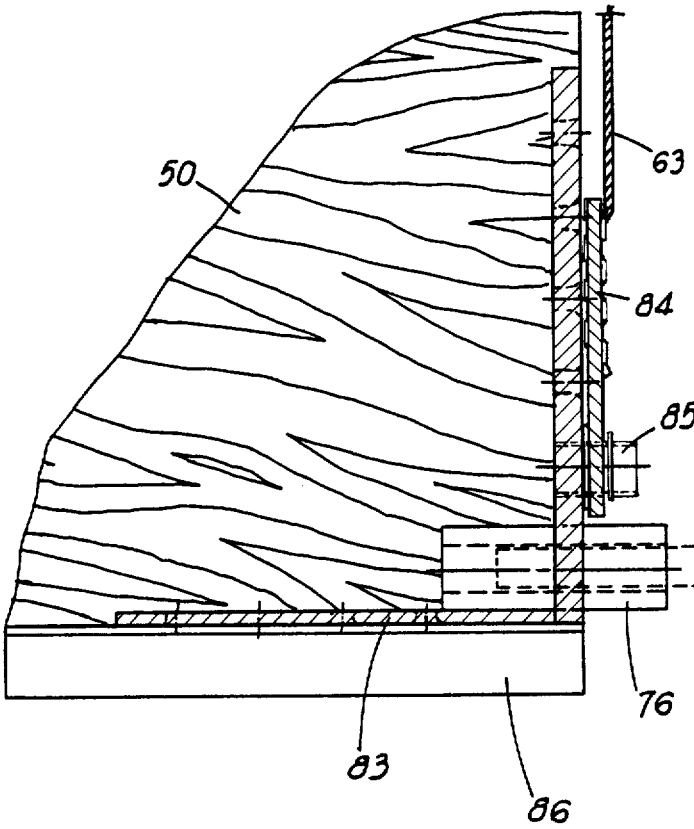
FIG. 10 is a fragmentary side elevation of a guide roller and lifting cable attachment assembly for the lowermost closure panel.
Figure 10A:
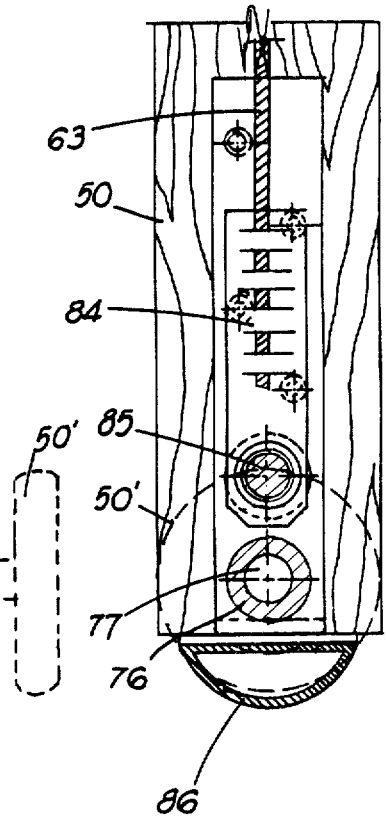
FIG. 10*a* is an end elevation thereof.

FIGS. 10 and 10*a* show similar guide roller mounting arrangement for the lowermost closure panel 50 or 72 to which the lifting cable means 63 is attached. An angle mounting plate 83 is employed on the lowermost panel section for increased strength. A stranded cable attachment plate 84 and pivot pin 85 for the same are used for the attachment of lifting cable means 63. A lower edge weather seal 86 for the closure is also shown. The position of guide roller axle sleeve 76 or bar relative to mounting plate 83 is a function of the geometry of seal 86 and the desired position of lowermost guide roller 50' relative to the floor.

Figure 11A:
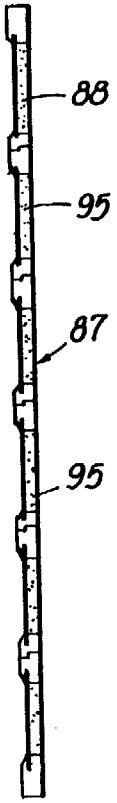
FIG. 11*a* is a vertical section taken on line 11*a*—11*a* of FIG. 11.
Figure 11:
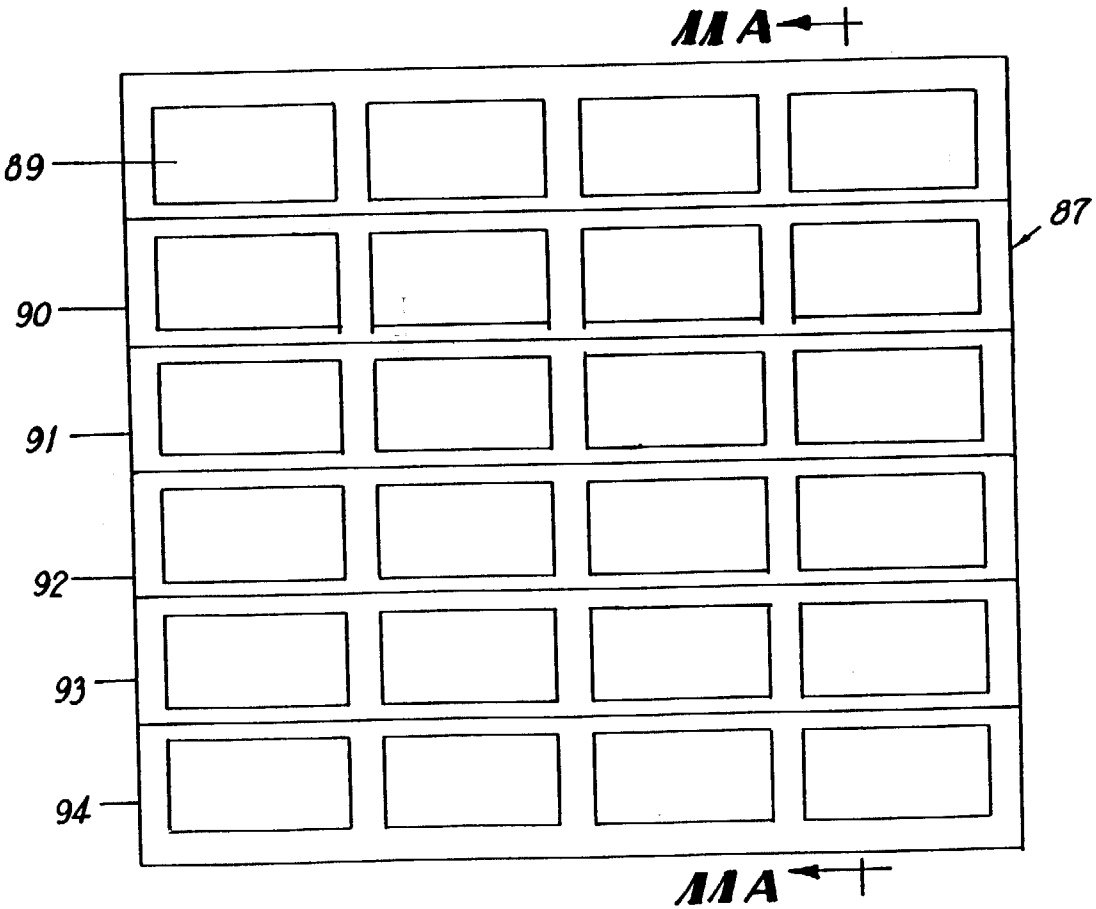
FIG. 11 is an exterior side elevation of a collapsing closure having a rail and stile exterior facade.

FIGS. 11 and 11*a* show another important feature of the invention in which a six panel vertically collapsing closure 87 is embodied in a garage door whose exterior surface, FIG. 11, is of popular rail and stile design.

As shown in FIG. 11*a*, the interior face 88 of the closure 87 is flush or continuous to match internal surroundings and each articulated closure panel 89, 90, 91, 92, 93 and 94 contains an insulating core 95 of substantial thickness. By virtue of this arrangement, the garage door forms a good thermal barrier while achieving the most popular appearance and other attributes of the invention already described. Customarily, rail and stile doors have panels which are only about one-quarter inch thick without thermal insulation.

Figure 12:
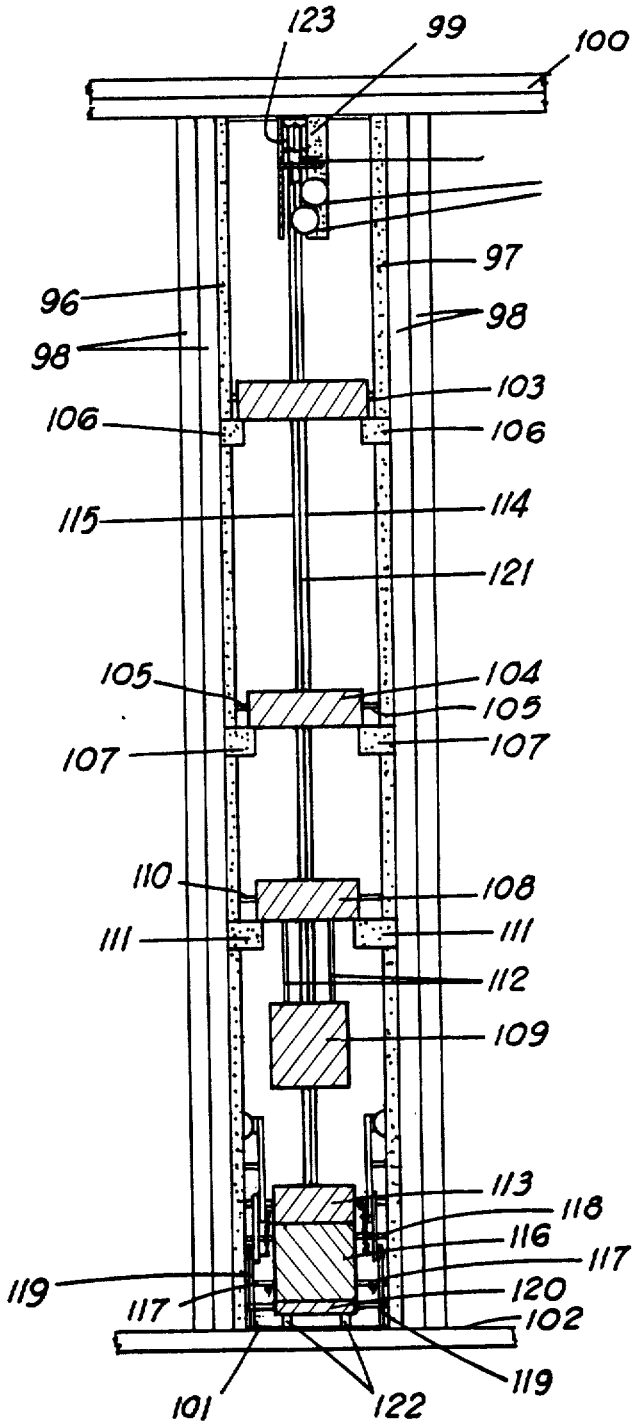
FIG. 12 is a fragmentary cross sectional view of a closure counterweight system.

FIGS. 12 through 17 show a simplified variable counterweight system for the vertically collapsing closure or partition forming another important aspect of the invention. FIG. 12 shows the counterweight system ready for ascent, necessary to produce closure lowering. The counterweight raceway consists of side tracks 96 and 97 fixed to adjacent studs 98 or the like. A header plate 99 attaches to top members 100 and a lower plate 101 is fixed on a base plate 102.

Weight segments 103 and 104 are of one-piece form and equipped with guide rollers 105 at their opposite sides engaging tracks 96 and 97. The weight segments 103 and 104 are intercepted by projections 106 and 107 at fixed elevations, respectively.

Another weight segment consists of two weight parts 108 and 109. The upper part 108 has guide rollers 110 engaging guide tracks 96 and 97. The weight part 108 is arrested by projections 111. Weight part 109 is arrested by suspension rods 112 that are fixed to the upper weight part 108. The rods 112 and lower weight part 109 are such that the rods extend fully into the latter during all motion phases except the arrested configuration shown in FIG. 12. In this configuration, flanges on the lower ends of rods 112 have been intercepted by the upper surface of lower weight part 109. These flanges are omitted for simplicity. As arrested, the weight part 109 is supported by the rods 112 which in turn are supported by the upper weight part 108, supported by the side projections 111.

Figure 16B:
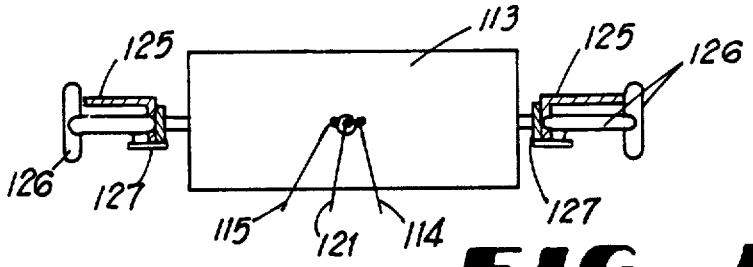
FIG. 16B is a plan view of parts shown in FIG. 16.
Figures 16, 16A:
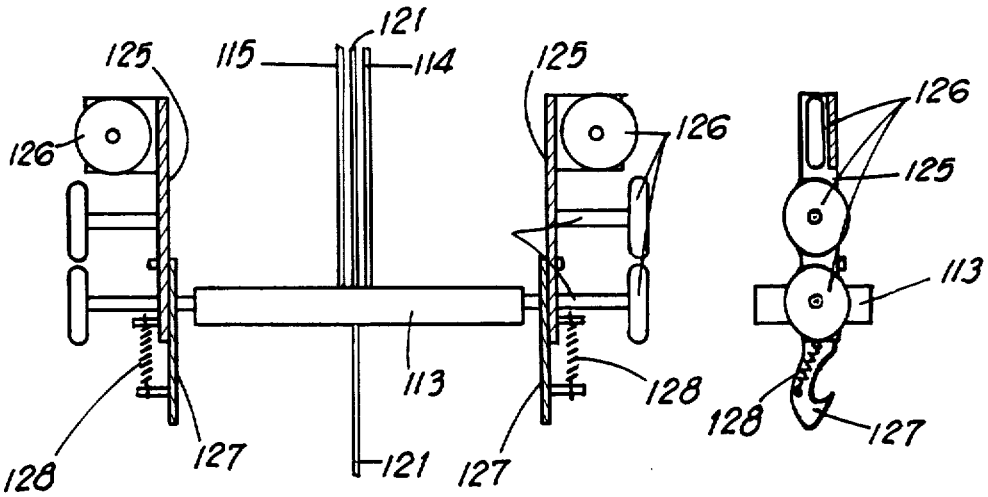
FIG. 16 is a fragmentary elevational view of a latching and unlatching device for the counterweights' platform.
FIG. 16A is a side elevation of parts shown in FIG. 16.

A weight segment 113 also serves as the counterweight support platform. FIG. 16 provides further detail of this element. The platform element 113 is connected to each lower corner of the closure by lifting cables 114 and 115, FIG. 16. It is connected to the underlying weight segment 116 by mechanical latches. Weight segment 116 consists of a single piece mass with two sets of guide rollers 117 and 118.

As will be further discussed, the counterweight system commences its ascent and hence the lowering of the closure 42 commences once the weight segment 116 is mechanically unlatched from the support platform 113. It is this action that effectively reduces all upper counterweight mass stages by the mass of the disconnected weight part 116. Hence, this action instantly reconfigures from the door opening geometry to door or closure closing geometry.

Mechanical devices 119 are operated by cable extending to the main external closure latch to cause the disconnect of weight segment 116 from platform element 113. Accordingly, weight segment 116 effectively serves as the latch component holding the closure in the open position. Weight segment 120 serves as a weight part. However, its primary role is as a platform for weight segment 116 and a return means for a cable 121 extending from it to a cable winding drum attached to a small electric motor, not shown. Cables 114 and 115 extend from the closure down through an opening centered in each weight segment 103, 104 and 108 to their points of attachment to the main weight support platform 113. Cable 121 extends from an electric motor, not shown, down through the same weight openings. However, it similarly passes through the platform 113 and the underlying weight component 116 to a center point of attachment with the secondary platform element or weight 120. Rubber bumpers 122 mounted on the lower raceway plate 101 act to terminate counterweight descent. An upper cable sheave assembly 123 is provided to guide the three cables 114, 115 and 121 from the counterweight raceway to their respective termination points.

Figure 13:
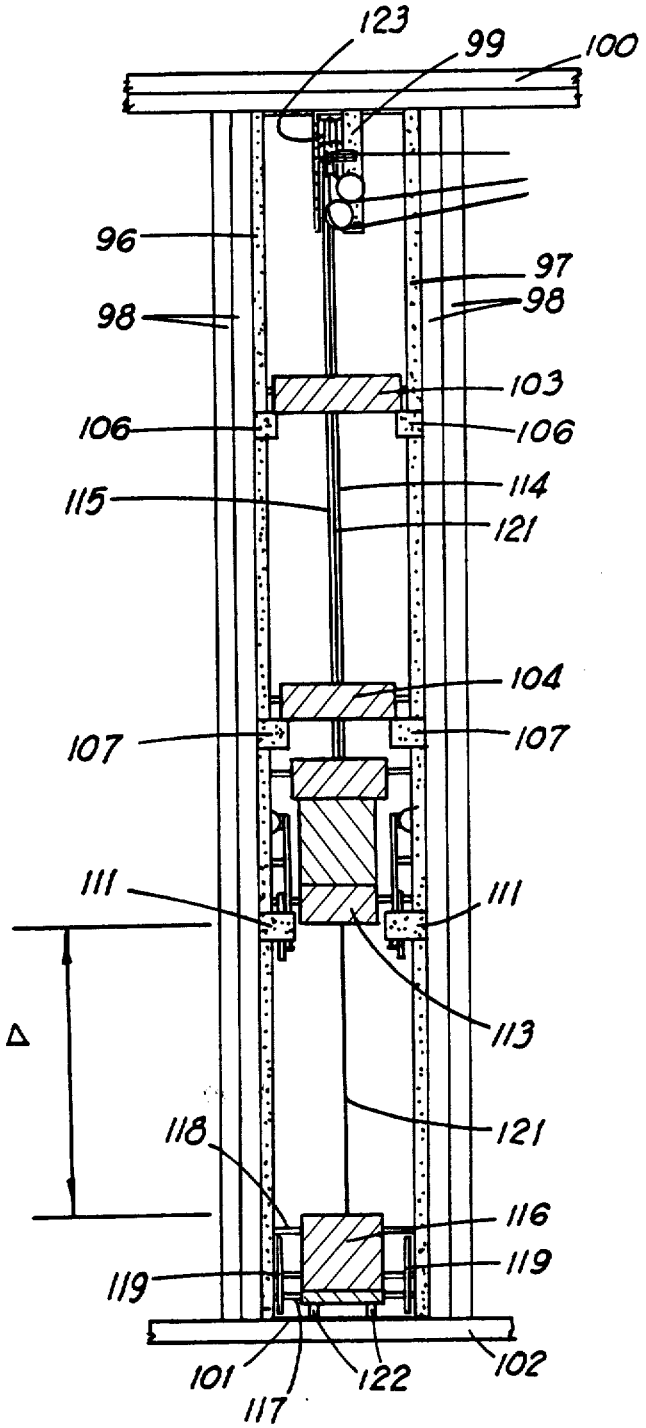
FIG. 13 is a similar view of the counterweight system when the closure is in the full up or opened condition.

In FIG. 13, the mechanical devices 19 have been activated, unlatching platform element 113 from weight segment 116. The closure 42 has commenced its descent and hence the counterweight its ascent. Weight segment 116 and secondary support platform 120 remain fixed at the bottom of the raceway. As shown in FIG. 13, the weight segment 104 is next to be added added to the effective traveling counterweight mass.

Figure 14:
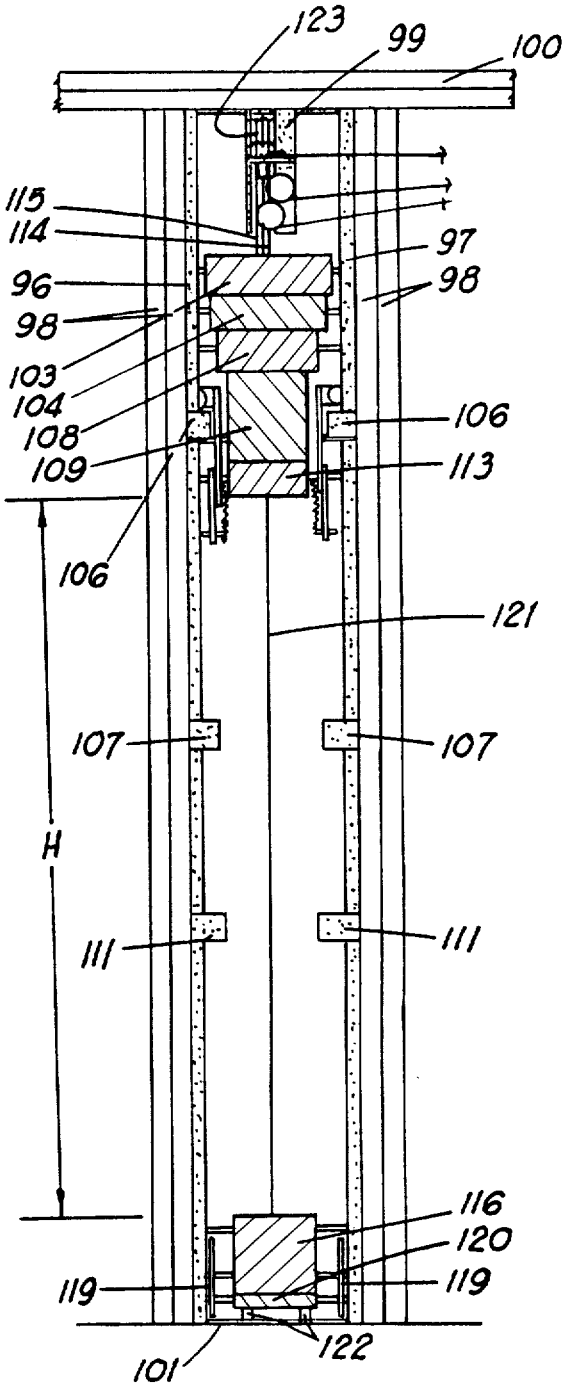
FIG. 14 is a similar view of the counterweight system arranged for closure opening.

FIG. 14 shows the counterweight system fully ascended in the raceway and corresponding to the full down position of the closure 42, 87 or the partition 64. The closure has now been mechanically locked down by latches at the bottoms of guide rails 40. The counterweight system is ready for subsequent closure opening by the raising of weight segment 116 and connection thereof to main support platform element 113. Mechanical latches mounted on the latter achieve such connection by engagement with the axles of the upper guide roller set 118. Upon reaching the full down position, the closure contacts a limit switch, not shown, which activates an electric motor. Cable 121 is then wound on a cable drum driven by the motor causing secondary support platform 120 to elevate weight segment 116 the required distance, at which point the connection of segment 116 with platform element 113 occurs. Simultaneously with this connection, weight segment 116 contacts another limit switch, not shown, causing the electric motor to reverse or stop and gear release in order that cable 121 can be retracted. Secondary weight support platform 120 now functions in its other role of insuring full retraction of cable 121.

Figure 15:
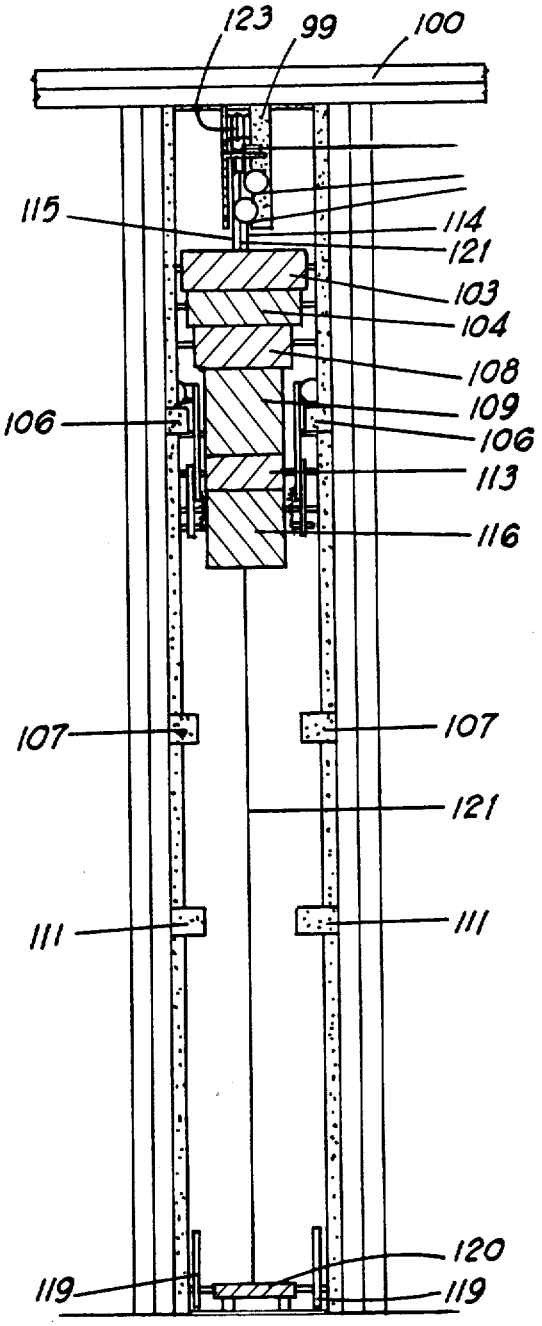
FIG. 15 is a similar view of the counterweight system in another operational mode.

FIG. 15 illustrates the resulting counterweight configuration now ready to effect closure raising once the lower mechanical closure latches are opened. As the cable retraction plate 120 approaches the full down position, a third limit switch is operated to stop the electric motor preparing it for the subsequent withdrawal of cable 121. In the system shown in FIGS. 12 through 15, the vertical closure can be raised and lowered without application of external energy. Only mechanical unlatching of the closure is necessary to initiate the movement cycle.

In FIGS. 16 through **16*b*, closure lifting cables 114 and 115 are fixed to platform element 113. Counterweight lift cable 121 freely passes through the provided opening 124, FIG. 16*b*. Guide roller equipped side brackets 125 are mounted on opposite sides of platform 113 to assure proper platform alignment. The platform guide rollers 126 are supported on brackets 125. Also, pivoting around these axles, are the mechanical latches 127 used to connect the platform assembly to the lower weight segment 116. Springs 128 are mounted on the latches 127 to assure the latter will deviate from the vertical only in response to engagement with the guide roller axles 118 of lower weight segment 116**.

Figure 17:
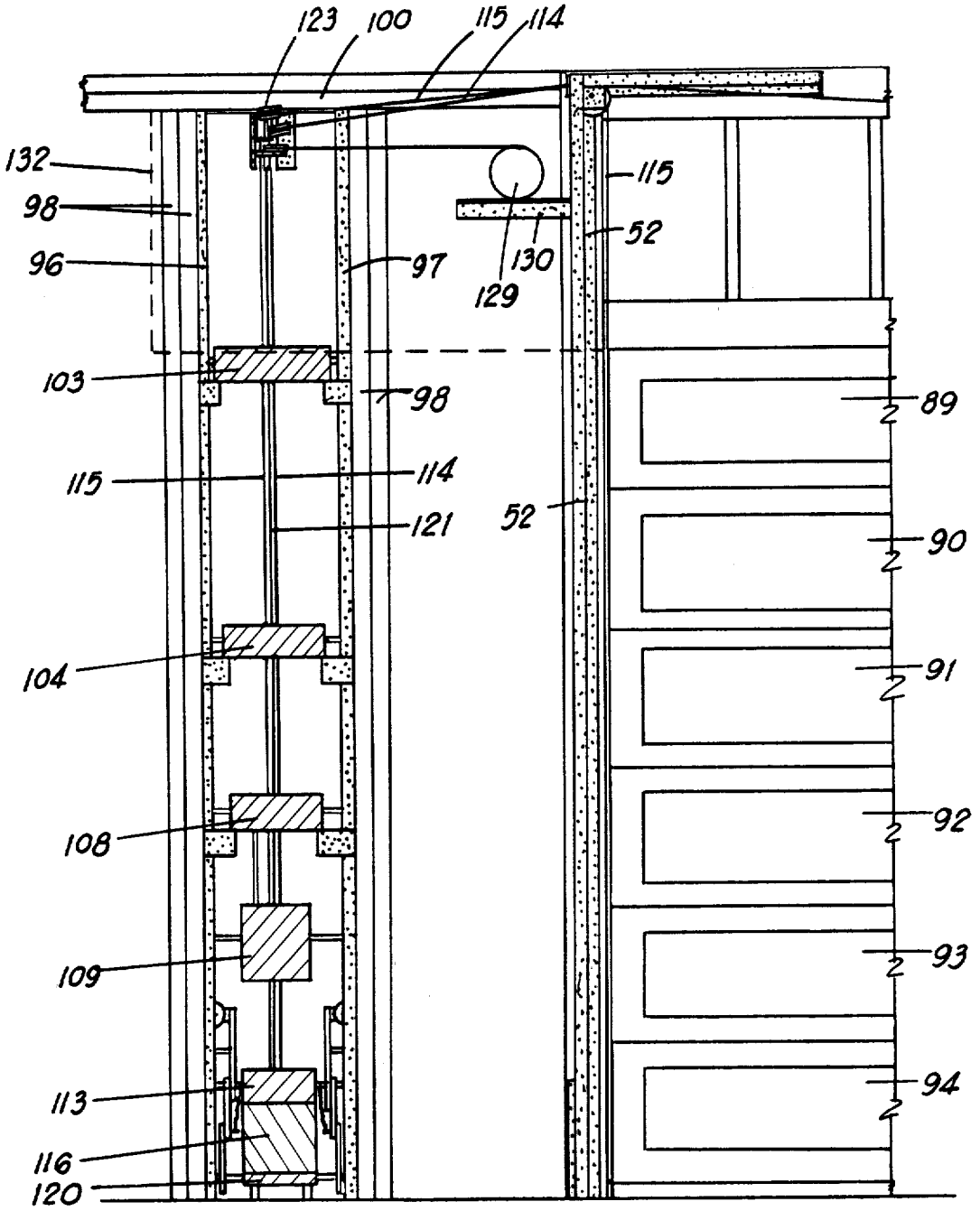
FIG. 17 is an elevational view, partly broken away and partly in section, of the closure, counterweight system and interconnecting cable means.

FIG. 17 shows the relationship of the described counterweight system to the closure support and guide system. The electric motor equipped with a cable winding drum 129 to retract cable 121 rests on a platform 130 attached to the adjacent upper closure guide track or pan 52. Lifting cable 115 is directed for attachment to the lower left hand corner of the closure via a sheave 131 at the top of the left hand upper guide track 52. Lifting cable 114 passes over an adjoining sheave at the same location and leads to another directional sheave similarly positioned on the right hand upper guide track or pan 52. As shown at 132 in FIG. 17, the overhead collapsing storage cabinet is extended to enclose the electric motor and its drum 129 and counterweight raceway cable directional sheave 123 at the top of the raceway.

Figure 18:
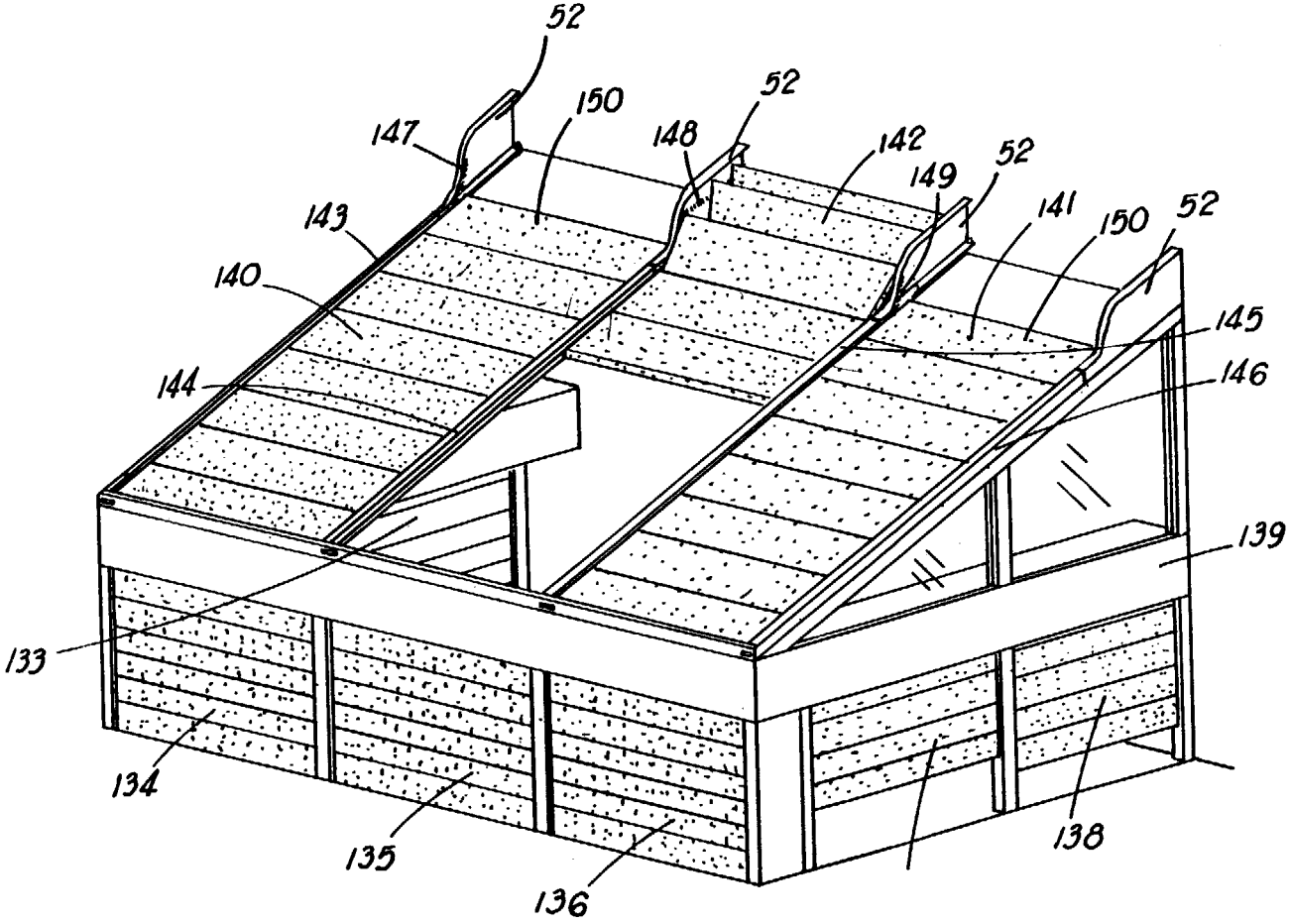
Figure 19:
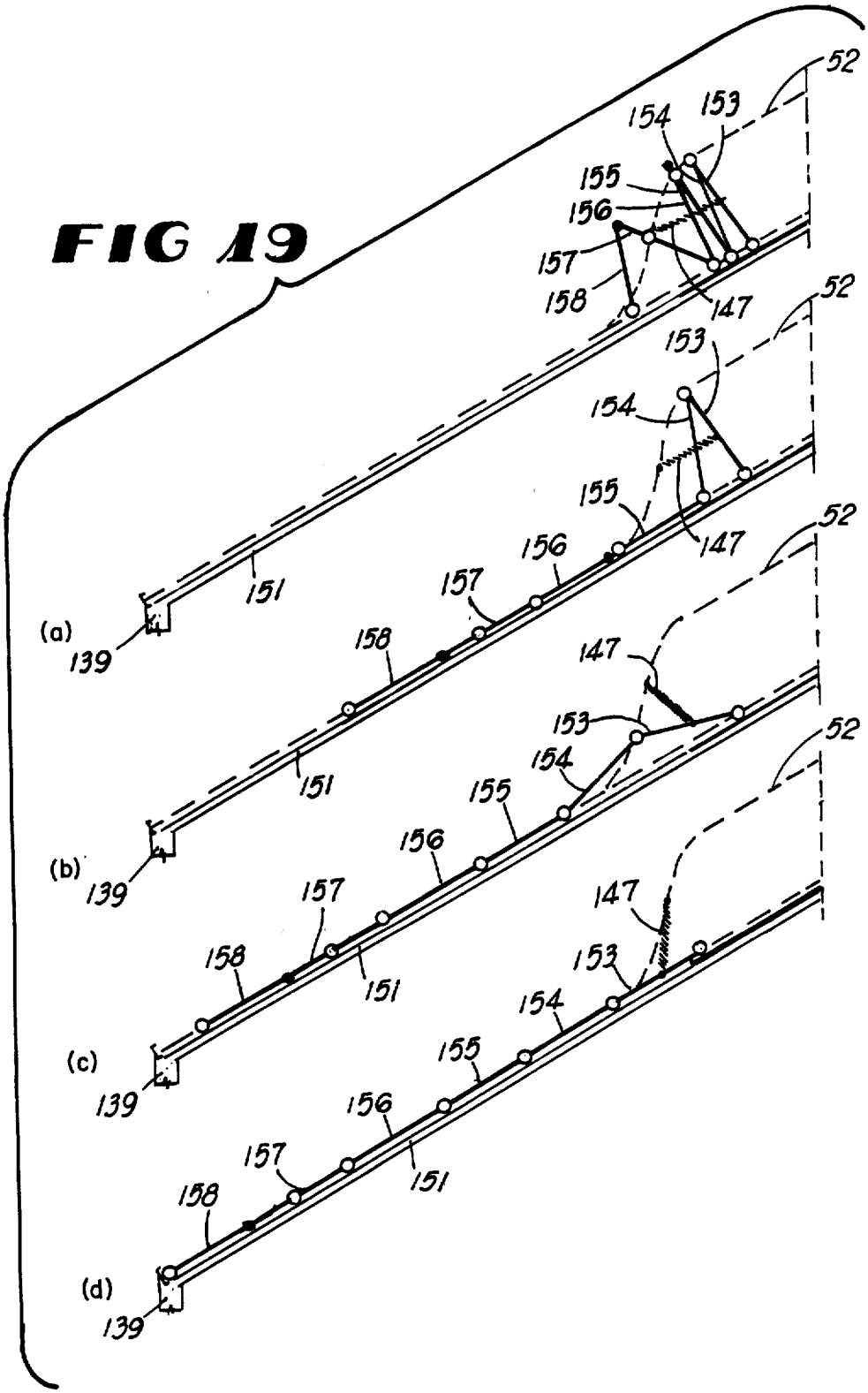
FIG. 19 is a composite schematic view showing the operational stages of the closure in FIG. 18.

Thus far, the present invention has been shown and described as a collapsing vertical closure or partition. FIGS. 18 and 19 show an application of the invention as an inclined roof, swimming pool cover or the like. More particularly, FIG. 18 illustrates a structure for enclosing a residential swimming pool. Vertically collapsing wall panels 133, 134, 135, 136, 137 and 138 according to the previously-described embodiments are shown. An extended cabinet 139 encloses the described upper guide tracks or pans 52 and allows overhead storage of the panels 133 through 138.

A roof structure consists of plural inclined collapsing closures or panels 140, 141 and 142. The intermediate collapsing panel 142 is shown in the partly collapsed state. The previously-described upper guide roller pans 52 are utilized in the inclined roof together with inclined longitudinal guide tracks 143, 144, 145 and 146 constructed like the vertical tracks 40. Springs 147, 148, 149 have been added connecting each pan 52 to an intermediate point along the edge of each uppermost panel section 150 of the plural section roof panels or closures.

The diagrams of FIG. 19 show the operation of the collapsing inclined roof panels. The added springs 147 on the pans 52 accommodate independent collapse of roof panels 140, 141 and 142.

Figure 20:
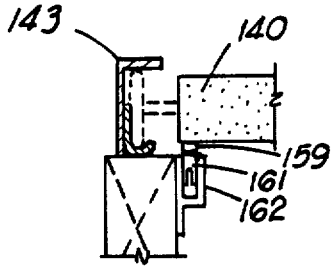
FIG. 20 is a fragmentary cross sectional view showing the lower roller guide rail and associated parts.

Cross sectional views of guide tracks 143 and 144 are shown in FIGS. 20 and **20*a*. All roof panels 140, 141 and 142** can be operated by a single counterweight system, or separately by individual counterweight systems. The panels may be opaque or translucent and may be formed of plastics or glass.

Referring to FIG. 19, the intermediate roof panel 142 has been illustrated schematically and employs six equal width collapsing panel sections for simplicity in lieu of eight sections as shown in FIG. 18. Lower diagram (a), FIG. 19, shows roof closure panel 142 fully extended and lying in one inclined plane above support roof joist 151. The tension spring 147 of diagram (a) extends between the transitional portion of pan 52 at the mid-point of the edge of upper panel section 153. In some cases, the weight of the roof panel and its slope may be such that panel collapse and extension can occur in response to gravity and the tensioned lifting cable only. In the case of lesser roof slopes, the spring is necessary to supplemental gravity forces in insuring that the upper panel section 153 is constrained relative to the lower panel sections 154, 155, 156, 157 and 158 so that proper panel collapsing occurs. The spring will also assist in the extension of the roof panel.

Diagram (b) in FIG. 19 shows the initial opening or collapsing of roof panel 142. A lifting force has been applied to lowermost panel section 158 and all articulated sections have commenced movement up the incline. Also, the panel collapse sequence has begun at the articulation axis of panel sections 153 and 154. The spring 147 has assisted the cable means, not shown, in this collapsing action.

Diagram (c) shows the continued collapsing of the roof panel 142 and the force of spring 147 is steadily increasing as panel sections 153 and 154 have completed their rotational phase.

Diagram (d) shows the full open or collapsed panel configuration which is basically the same as in the prior embodiments regarding latches and other mechanical details.

Figure 20A:
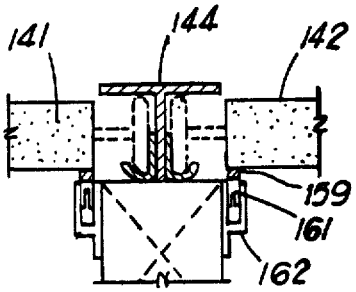
FIG. 20*a* is a similar view of the lower roller guide rail as it accommodates the end rollers of a pair of closure panels.
Figure 20B:
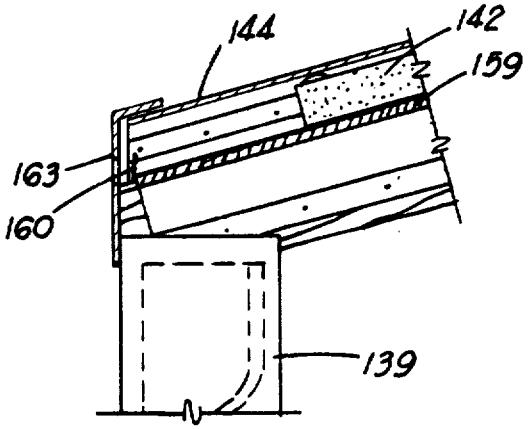
FIG. 20*b* is a fragmentary side elevation showing the juncture of components in FIG. 20*a* with the perimeter wall box beam.

FIG. **20*b* is a side elevation of the structure in FIG. 20*a* and of the perimeter cable 139. A weather seal 159** will be thrust against the underside of panel 142 as the latter contacts a weatherstrip projection 160 forcing in turn the insert bar 161 to thrust outwardly from weatherstrip case 162. A facia strip 163 is shown equipped with an opening to permit drainage.

FIG. 21 and FIGS. 21*a* through 21*c* show a modified upper roller guide rail in lieu of the guide rail or pan 52, previously described. An alternate means of achieving closure panel section guide roller diversion is made available. More particularly, a curved interceptor plate 164 is added to the lower curved terminal of the roller constraint flange 165. As shown in FIG. 21*c*, the two elements 164 and 165 are perpendicular and the element 164 is spaced from and parallel to the body portion 166 of the roller guide unit. In other respects, the unit corresponds to the previously-described unit 52.

Figure 22:
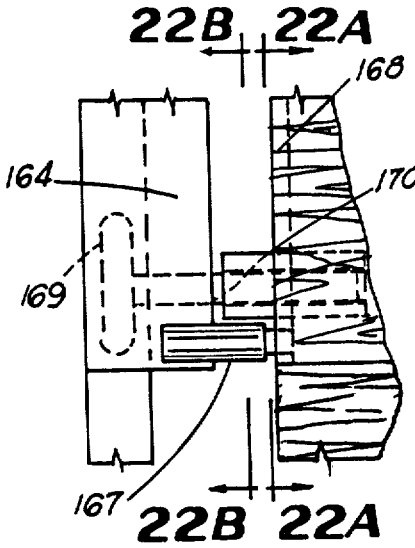
FIG. 22 is a fragmentary side elevation of a closure mounted cam follower and associated parts.
Figure 22A:
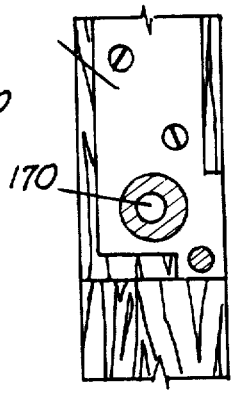
FIG. 22*a* is a fragmentary vertical section taken on line 22*a*—22*a* of FIG. 22.
Figure 22B:
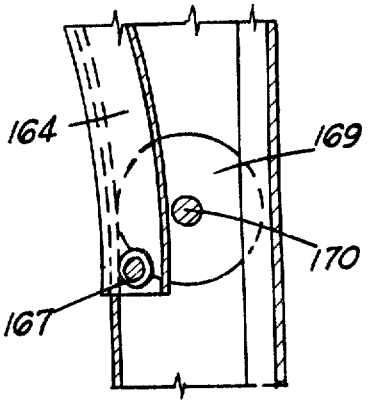
FIG. 22*b* is a similar section taken on line 22*b*—22*b* of FIG. 22.

In FIGS. 22 through 22*b*, a cam follower 167 is attached to the diversion guide roller mounting plate 168 in a manner which allows the cam follower to coact with the curved interceptor plate 164 to achieve interception and controlled diversion of the closure panel section guide roller 169 to cause proper collapse of the closure hinge joint. The interceptor plate 164 need extend only a limited distance along the roller constraint flange 165, as lateral components of hinge joint forces are sufficient to complete the collapsing or folding action. The interceptor plate 164 is positioned so that its outer projecting flange extends between the guide roller axle 170 and the cam follower 167 without contacting either, FIG. 22*b*, during their entry into the restricting region of the interceptor plate 164. While the cam follower 167 is within the latter, the projecting flange of interceptor plate 164 is positioned outwardly from the guide roller constraint surface such that the guide roller must slightly rise from the latter in order that the cam follower 167 engage and, hence, be constrained by the projecting flange of the interceptor plate. Additionally, such outward positioning is limited to preclude interference with the guide roller axle 170. The improved guide roller constraint and diversion structure is simple, positive, reliable and economical to manufacture.

Figure 23:
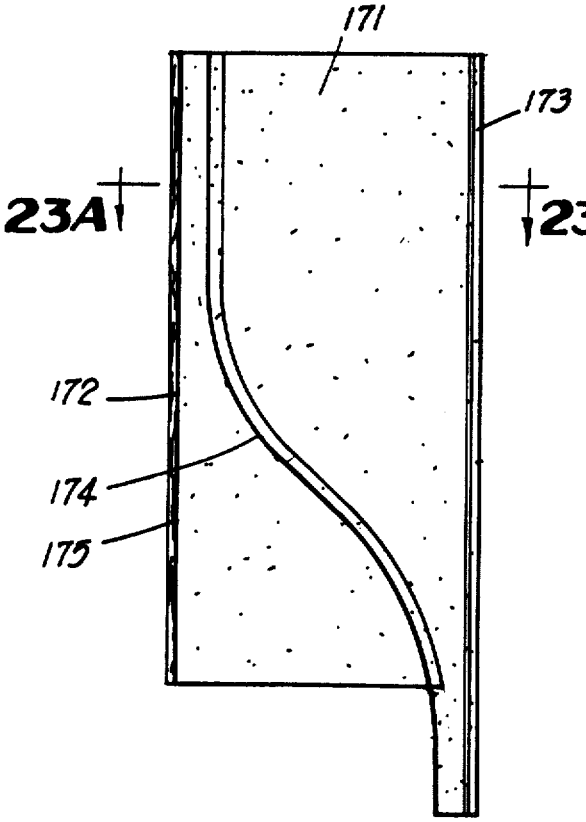
FIG. 23 is a side elevation of a further modified upper roller guide rail system.
Figure 23A:
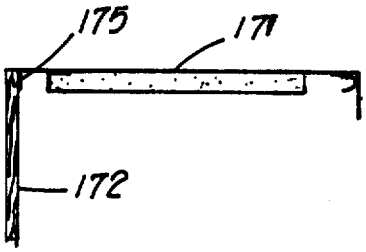
FIG. 23*a* is a horizontal section taken on line 23*a*—23*a* of FIG. 23.

In FIGS. 23 and 23*a*, the upper guide roller tracking units are modified to enable the solid web or plate elements 171 to also serve as the end walls of the overhead storage cabinet 172 for the vertically collapsing closure. To facilitate this, the element 171 is formed rectangular to match the cabinet geometry and straight and curved constraint rails or flanges 173 and 174 are provided to afford the necessary panel section roller guidance and diversion. The flange 174 can be welded to the flat plate or wall 171. A vertical flange 175 is formed integral with the wall 171 to facilitate attachment of the front cabinet panel 172.

Figure 24:
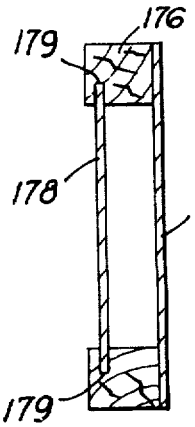
FIG. 24 is a fragmentary vertical section taken through one panel of a rail and stile insulated collapsing closure depicting a feature of the invention.

In FIG. 24, a feature is shown to prevent twisting of the frame 176 of an insulated rail and stile closure panel due to thermal expansion and contraction of the inner and outer panels 177 and 178. To alleviate this problem, the outer panel 178 has a snug slip fit within mounting grooves 179, with small voids provided by the grooves to allow the necessary relative movement due to thermal contraction or expansion. The inner panel 177 is glued fixedly to the frame 176.

It is to be understood that the forms of the invention herewith shown and described are to be taken as preferred examples of the same, and that various changes in the shape, size and arrangement of parts may be resorted to, without departing from the spirit of the invention or scope of the subjoined claims.

I claim:

1. In a collapsing closure system, a closure including plural equal width panel sections which are hingedly connected along parallel hinge axes to allow overhead collapse and storage of the closure in a compact form and downward extension thereof, linear and upper diversionary guide track means for said closure, and coacting guide roller means for said closure engaging said linear and diversionary guide track means, said guide roller means including opposite side guide roller pairs for the closure located on the hinge axes of said closure panel sections except for two pairs of the guide rollers of two intermediate panel sections which are displaced in a common direction and unequally from the lower hinge axis of the panel sections carrying said two pairs of guide rollers.

2. In a collapsing closure system as defined in claim 1, and the intermediate pair of closure panels carrying the displaced pairs of guide rollers being separated by another intermediate panel section of the closure.

3. In a collapsing closure system as defined in claim 2, and the displacement distance of the lower pair of displaced guide rollers above the adjacent hinge axis being greater than the displacement distance of the upper pair of the displaced guide rollers above the adjacent hinge axis.

4. In a collapsing closure system as defined in claim 3, and the lower pair of displaced guide rollers having their axes fixed on the closure panel section carrying them substantially at the center of said panel section between the hinge axes thereof.

5. In a collapsing closure system as defined in claim 1, and an overhead storage cabinet means for the collapsed closure and enclosing the latter and said upper diversionary guide track means.

6. In a collapsing closure system as defined in claim 1, and the upper diversionary guide track means comprising a pair of opposite side shallow pan-like sheet metal units having integral linear and curved diversionary track flanges, and the linear flanges of the pan-like units serving as mounting flanges for the units on a wall or the like.

7. In a collapsing closure system as defined in claim 6, and a curved face roller guide rail element attached to each pan-like unit interiorly of said linear flange.

8. In a collapsing closure system as defined in claim 7, and a closure lifting cable sheave assembly attached to each pan-like unit near the top thereof.

9. In a collapsing closure system as defined in claim 6, and each pan-like unit being of rectangular configuration enabling it to form a closure storage cabinet end wall, and a curved guide roller diversionary track element fixed on each pan-like unit in spaced relation to a linear edge flange thereof.

10. In a collapsing closure system as defined in claim 6, and each pan-like unit carrying a curved interceptor plate along a lower curved edge portion thereof and being attached substantially at right angles to an adjacent curved guide roller constraint flange of the unit, the interceptor plate being spaced from and parallel to the major flat wall of the pan-like unit, and a coacting cam follower element attached to each end of each closure panel section adjacent to the two guide rollers thereof.

11. In a collapsing closure system as defined in claim 1, and said guide roller means including opposite side guide roller axle support sleeves on each closure panel section within which the guide roller axles are radially constrained but are able to move freely axially.

12. In a collapsing closure system as defined in claim 9, and the inner ends of said support sleeves being deeply recessed in said panel sections for stability.

13. In a collapsing closure system as defined in claim 1, and the exterior faces of the closure panel sections being formed in a rail and stile grid configuration, their interior surfaces being flat and lying in a common plane when the closure is completely extended.

14. In a collapsing closure system as defined in claim 11, and core elements of thermal insulation disposed between the exterior and interior facing elements of each closure panel section.

15. In a collapsing closure system as defined in claim 1, and said closure when fully extended downwardly being substantially vertical and forming a door for a garage or the like.

16. In a collapsing closure system as defined in claim 1, and said closure when downwardly extended having all of its panel sections lying in a common substantially vertical plane to form an upwardly collapsing and overhead storing interior building partition, the building having an overhead storage space above a ceiling thereof and said storage space receiving said upper diversionary guide track means therein.

17. In a collapsing closure system as defined in claim 14, and a counterweight means for said interior building partition concealed within an adjacent permanent wall of the building.

18. In a collapsing closure system as defined in claim 1, and said closure when fully extended having its panel sections lying in a common inclined plane to serve as a roof or the like, and spring means connected with at least the uppermost panel section to assist in the collapsing of the closure in response to an upward force applied to the lowermost panel section thereof in said inclined plane.

19. In a collapsing closure system as defined in claim 18, and a plurality of said closures in side-by-side relation in said common inclined plane and being independently operable between extended and collapsed states.

20. In a collapsing closure system as defined in claim 19, and an intermediate one of said closures sharing common inclined guide track means with two outer side closures in said common inclined plane.

21. In a collapsing closure system as defined in claim 1, and a variable counterweight means for said closure disposed in a raceway near one side thereof and operatively connected with the closure by guided cable means.

22. In a collapsing closure system as defined in claim 21, and said counterweight means including a mass component having a latching means operable to release said component for movement above and away from an underlying larger mass component and a supporting platform element therefor so that the effective weight of the counterweight means when rising is reduced during closure descent, and the larger mass component adapted to rise into latched engagement with the latching means of the first-named mass component to increase the effective mass of the counterweight means at the commencement of closure ascent.

23. In a collapsing closure system as defined in claim 22, and spaced fixed interceptor elements for the components of the counterweight means in said raceway to arrest the descent of the components individually.

24. In a collapsing closure system as defined in claim 23, and the counterweight means including a counterweight component also serving as a main counterweight support platform.

25. A collapsing closure comprising a plurality of hingedly connected closure panel sections having parallel hinge axes and lying in a common plane when the closure is in an extended state, the collective front faces of the panel sections then forming a rail and stile facade and the rear faces thereof being flat and occupying a common plane, the closure panel sections being hollow and being filled with thermal insulating material, each closure panel section having top and bottom spaced parallel frame members, a rear flat panel fixed to the rear faces of said frame members and covering the latter, and a front parallel panel spaced from the rear panel and spaced somewhat rearwardly from the front faces of said top and bottom frame members, and the opposing bottom and top faces of the top and bottom frame members having aligned grooves formed therein receiving top and bottom edge portions of the front panel with sufficient clearance in said grooves to accommodate thermal contraction and expansion of the closure panel section with resultant movement of said front panel relative to the top and bottom frame members without twisting or warping of the closure panel section.

* * * * *